US007727134B2

(12) United States Patent
Nakamura et al.

(10) Patent No.: US 7,727,134 B2
(45) Date of Patent: Jun. 1, 2010

(54) DEVELOPING ROLLER, PROCESS FOR ITS PRODUCTION, DEVELOPING ASSEMBLY AND IMAGE FORMING APPARATUS

(75) Inventors: Minoru Nakamura, Susono (JP); Masahiro Watanabe, Mishima (JP); Kazuaki Nagaoka, Susono (JP); Hidenori Satoh, Odawara (JP)

(73) Assignee: Canon Kabushiki Tokyo (JP)

( * ) Notice: Subject to any disclaimer, the term of this patent is extended or adjusted under 35 U.S.C. 154(b) by 894 days.

(21) Appl. No.: 11/551,446

(22) Filed: Oct. 20, 2006

(65) Prior Publication Data

US 2007/0111872 A1 May 17, 2007

(30) Foreign Application Priority Data

Nov. 10, 2005 (JP) ..... 2005-326168

(51) Int. Cl.
*B05C 1/08* (2006.01)

(52) U.S. Cl. ..... 492/18; 492/17

(58) Field of Classification Search ..... 492/17–18
See application file for complete search history.

(56) References Cited

U.S. PATENT DOCUMENTS 3,935,277 A * 1/1976 Dear et al. ..... 568/46
4,301,053 A * 11/1981 Wolfrey ..... 524/104
5,047,270 A * 9/1991 Mori et al. ..... 428/35.2
6,824,845 B2 * 11/2004 Wachi et al. ..... 428/32.81
2003/0044584 A1 * 3/2003 Wachi et al. ..... 428/195
2007/0292181 A1 * 12/2007 Oda et al. ..... 399/377

FOREIGN PATENT DOCUMENTS

JP 7-013415 1/1995
JP 9-087354 3/1997

* cited by examiner

*Primary Examiner*—David P Bryant
*Assistant Examiner*—Jacob J Cigna
(74) *Attorney, Agent, or Firm*—Fitzpatrick, Cella, Harper & Scinto

(57) ABSTRACT

A developing roller having a surface layer which contains a urethane resin composed of a reaction product of an isocyanate with a group of specific alcohols and has a surface having a contact angle to ethylene glycol of from 60.0 degrees or more to 90.0 degrees or less and a contact angle to diiodomethane of from 30.0 degrees or more to 38.0 degrees or less. The developing roller is highly reliable as having controlled banding which is an image difficulty caused at the part of contact between the developing roller and a developer feed roller.

13 Claims, 2 Drawing Sheets

DEVELOPING ROLLER, PROCESS FOR ITS PRODUCTION, DEVELOPING ASSEMBLY AND IMAGE FORMING APPARATUS

BACKGROUND OF THE INVENTION

1. Field of the Invention

The present invention relates to a developing roller used in, e.g., electrophotographic image forming apparatus such as copying machines and laser beam printers, and also relates to a process for its production, and a developing assembly and an image forming apparatus which make use of the developing roller.

2. Description of the Related Art

Electrophotographic image forming apparatus which employ a pressure development process are known as electrophotographic image forming apparatus such as copying machines, laser beam printers, and receiving sets of facsimile machines. The pressure development process is a development process in which a non-magnetic one-component developer is used as a developer and the developer is made to adhere to an electrostatic latent image held on a photosensitive drum, to render the latent image visible. This process is widely used because it requires no magnetic material, facilitates manufacture of simple and compact apparatus, and also facilitates preparation of color developers.

An electrophotographic image forming apparatus employing such a pressure development process has, as shown in FIG. 3, an image bearing member for holding thereon an electrostatic latent image such as a photosensitive drum 21 rotatable by a rotating mechanism, and, disposed around this photosensitive drum 21, a charging member 22 which makes the photosensitive drum 21 charged electrostatically. This electrophotographic image forming apparatus further has an exposure unit. It makes laser beam 23 irradiate the photosensitive drum 21 and thereby, the photosensitive drum 21 is discharged at the area where the laser beam 23 irradiates, and electrostatic latent images are formed on the photosensitive drum 21 which correspond to the images to be finally formed. This electrophotographic image forming apparatus still further has a developing assembly and a transfer roller 29. The developing assembly feeds a developer to the electrostatic latent images formed on the photosensitive drum 21, to perform development, and the transfer roller 29 transfers the developer having adhered to the electrostatic latent image, onto a transfer material (recording material). It still further has a cleaning blade 30 which destaticizes the surface of the photosensitive drum 21 from which the developer has been transferred and performs cleaning, and a fixing assembly 32 which fixes the developer held on the transfer material. The above developing assembly is provided with a developing roller 25, a developer feed roller 26 which coats the surface of the developing roller 25 with a developer 28 held in a developer container 34, and a developing blade 27 which adjusts to a more uniform thin layer the developer with which the surface of the developing roller 25 is kept coated. The developing roller 25 rotates while feeding to the photosensitive drum 21 the developer made uniform by the aid of the developing blade and coming into contact or proximity to the photosensitive drum 21, to make the thin-layer developer adhere to the latent images formed on the photosensitive drum 21 and render visible the latent images formed on the photosensitive drum 21.

The developing roller is required to be well durable to the heat generated when electrified at a high voltage for a long time, not to cause contamination of the photosensitive drum 21 particularly because of decomposition of a high molecular material member, and not to cause changes in electrical resistance of the member (Japanese Patent No. 3186541). The developing roller may further undergo environmental changes in temperature, moisture and so forth to come to cause deflection of electrical resistance in a large width, and this may cause a great change in image density (Japanese Patent Application Laid-open No. H07-13415). Further, when an electrophotographic image forming apparatus is kept unoperated for a long period of time, the developing roller and a developer feed roller, both of which are at standstill, are brought into contact with each other for a long period of time. In such an occasion, any components bled out of the developer feed roller, hereinafter called "bleeding component", may adhere to the surface of the developing roller, and such a developing roller may result in an undesirable "banding" or a density variation in the direction of drum rotation in an electrophotographic image. The banding is conspicuous in a halftone image or low-contrast image, and may remarkably occur when the electrophotographic image forming apparatus is kept unoperated under an environment of high-temperature and high-humidity, e.g., 40° C./95% RH over a long period of time.

SUMMARY OF THE INVENTION

An object of the present invention is to provide a developing roller having a high reliability, a process for its production, and a developing assembly and an image forming apparatus which make use of the developing roller.

Taking account of the above problem, the present inventors have made many extensive studies in order to obtain a developing roller having a surface to which any components bleeding out of the developer feed roller can not easily adhere. In the course of such studies, the present inventors have considered that the surface free energy of the developing roller is a predominant factor of the disposition of adhesion of such bleeding components. Accordingly, in order to calculate the surface free energy on the basis of the Kitazaki and Hata's theory, the present inventors have measured contact angles to water, diiodomethane and ethylene glycol, of developing rollers having surface layers formed of various polymer materials. Then, they have calculate the surface free energy by using these contact angles, whereas it has been unable to find out any clear relationship between the value of surface free energy and the disposition of adhesion of the bleeding components. More specifically, even in the case of a developing roller having a surface layer with a small surface energy, it has come about in some cases that the bleeding components have adhered to the roller surface to cause faulty images coming from such adhesion. However, in the course of such experiments, the present inventors have discovered that a developing roller having a surface layer which is formed of a urethane resin obtained by allowing the following component (a) to react with the following components (b) to (d) or the following components (b) and (e) and has a surface having a contact angle to ethylene glycol of from 60.0 degrees or more to 90.0 degrees or less and a contact angle to diiodomethane of from 30.0 degrees or more to 38.0 degrees or less cannot necessarily prevent the bleeding components from adhering to the roller surface but can reduce the magnitude of image defects such as banding resulting from the bleeding components having adhered to the roller surface. The present invention has been made on the basis of such a novel finding.

According to one aspect of the present invention, there is provided a developing roller which comprises a shaft member, and an elastic layer which covers the peripheral surface thereof, the developing roller having a surface layer which comprises a urethane resin composed of a reaction product of the following component (a) with alcohols comprising the following components (b) to (d) or the following components (b) and (e), and has a surface having a contact angle to ethylene glycol of from 60.0 degrees or more to 90.0 degrees or less and a contact angle to diiodomethane of from 30.0 degrees or more to 38.0 degrees or less, (a) an isocyanate;

(b) an alcohol containing a unit represented by the following formula (1);

(c) an alcohol containing a unit represented by the following formula (2);

(d) an alcohol containing a unit represented by the following formula (3); and (e) an alcohol containing a unit represented by the following formula (2) and a unit represented by the following formula (3):

(1)

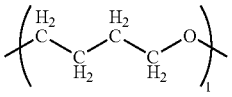

wherein l represents a positive integer;

(2)

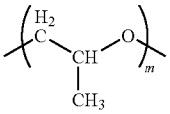

wherein m represents a positive integer;

(3)

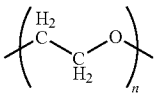

wherein n represents a positive integer.

According to another aspect of the present invention, there is provided a process for producing the above developing roller, comprising the steps of:

covering the peripheral surface of a shaft member or an elastic layer with a composition containing the above component (a) and the above components (b) to (d) or the above components (b) and (e), and then allowing the component (a) to react with the components (b) to (d) or the components (b) and (e) to form the above surface layer.

Further features of the present invention will become apparent from the following description of exemplary embodiments with reference to the attached drawings.

DESCRIPTION OF THE EMBODIMENTS

The present invention is described below in detail with reference to the accompanying drawings.

<Developing Roller>

Figure 1:
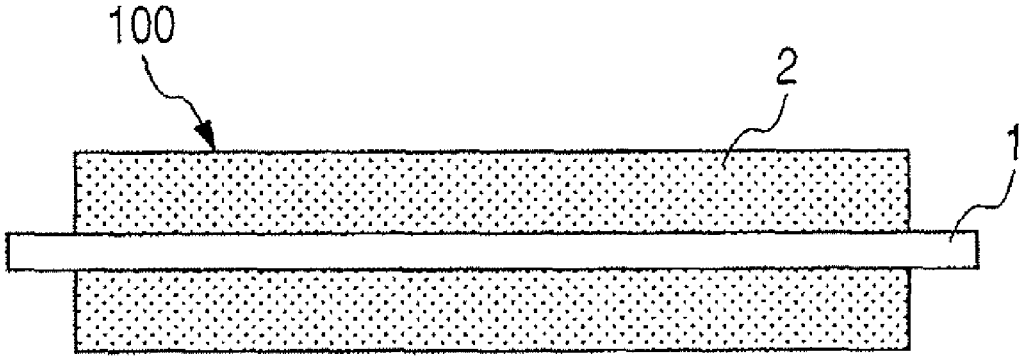
FIG. 1 is a schematic sectional view in the axial direction, showing an embodiment of the developing roller according to the present invention.

A sectional structure of an example of an embodiment of the developing roller according to the present invention is shown in FIG. 1. A developing roller 100 according to what is shown in FIG. 1 has an elastic layer 2 as a surface layer, on the peripheral surface of a highly conductive shaft (shaft member) 1. The elastic layer 2 has a surface having a contact angle to ethylene glycol of from 60.0 degrees or more to 90.0 degrees or less and a contact angle to diiodomethane of from 30.0 degrees or more to 38.0 degrees or less. The elastic layer 2 also contains a urethane resin which is a reaction product of the following component (a) with the following components (b) to (d) or the following components (b) and (e)

(a) an isocyanate;

(b) a first alcohol containing a unit represented by the following formula (1);

(c) a second alcohol containing a unit represented by the following formula (2);

(d) a third alcohol containing a unit represented by the following formula (3); and (e) a fourth alcohol containing a unit represented by the following formula (2) and a unit represented by the following formula (3):

(1)

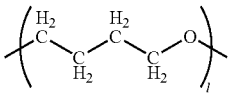

wherein l represents a positive integer;

(2)

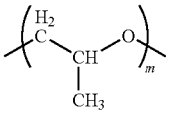

wherein m represents a positive integer;

(3)

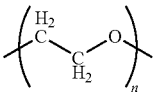

wherein n represents a positive integer.

Such a developing roller, even where it is kept over a long period of time in contact with a developer feed roller having as a surface layer a foamed elastic layer containing a copolymer of a silicone with a polyether, as described later, can very effectively keep the quality level of electrophotographic images from being affected by any components bleeding out of the developer feed roller. The use of such a developing roller can provide an image forming apparatus which can stably supply images with a high quality level.

The urethane resin in the surface layer according to the present invention contains all the units represented by the formulas (1) to (3). The units represented by the formulas (1) to (3) differ from one another in the number of ether group(s) with respect to the number of carbon atoms, and hence the van der Waals force and so forth of the surface layer can precisely be controlled, as so presumed.

Then, in the present invention, in the case when the first to third alcohols are used in synthesizing the urethane resin, it is preferable that these alcohols are in a mass ratio (first alcohol: second alcohol:third alcohol) of from 100:3:2 to 100:25:20. In this case, it is further preferable that the first alcohol is an alcohol having two or more hydroxyl groups and the second alcohol and the third alcohols are each an alcohol having one hydroxyl group. The urethane resin thus obtained has a structure wherein the units represented by the formulas (2) and (3) have pendently linked to the polymer backbone chain. Then, the surface layer containing such a urethane resin can have the surface having the contact angle to ethylene glycol of from 60.0 degrees or more to 90.0 degrees or less and the contact angle to diiodomethane of from 30.0 degrees or more to 38.0 degrees or less.

In the present invention, in the case when the first alcohol and the fourth alcohols are used in synthesizing the urethane resin, it is preferable that these alcohols are in a mass ratio (first alcohol:fourth alcohol) of from 100:5 to 100:40. In this case, it is further preferable that the first alcohol is an alcohol having two or more hydroxyl groups and the fourth alcohol is an alcohol having one hydroxyl group. The urethane resin synthesized using such alcohols also has a structure wherein the units represented by the formulas (2) and (3) have pendently linked to the polymer backbone chain. Then, the surface layer containing such a urethane resin can have the surface having the contact angle to ethylene glycol of from 60.0 degrees or more to 90.0 degrees or less and the contact angle to diiodomethane of from 30.0 degrees or more to 38.0 degrees or less.

As stated previously, the urethane resin in the surface layer of the developing roller according to the present invention always contains all the units represented by the formula (1), formula (2) and formula (3) as an alcohol used for raw materials.

Examples of the component (a), which is a raw material of the urethane resin according to the present invention, include the following: Tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetrametylxylylene diisocyanate (TMXDI) and cyclohexane diisocyanate.

Of these, aromatic diisocyanates such as TDI, MDI, NDI, PPDI, XDI and TMXDI are preferred. In particular, MDI is more preferred because it enables achievement of an improvement in restoring properties of the developing roller after application of any local load thereto.

The elastic layer as a surface layer may be constituted of only the urethane resin having been herein described, but may further contain other polymer component(s) as long as its/their use does not deviate from what is aimed in the present invention.

Examples of such other component(s) include(s) the following: Natural rubber (NR), butyl rubber (isobutylene-isoprene rubber, IIR), nitrile rubber (NBR), polyisoprene rubber (IR), polybutadiene rubber (BR), silicone rubber, styrene-butadiene rubber (SBR), ethylene-propylene rubber (EPM), ethylene-propylene-diene rubber (EPDM), chloroprene rubber (CR), acrylic rubbers (ACM), and a mixture of any of these.

Of these, elastomers or resins such as silicone rubber and EPDM are particularly preferred. These elastomers or resins may be used in such quantity that the outermost layer elastic layer 2 can have the surface having the contact angle to ethylene glycol of from 60.0 degrees or more to 90.0 degrees or less and the contact angle to diiodomethane of from 30.0 degrees or more to 38.0 degrees or less.

The elastic layer 2 of the developing roller shown in FIG. 1 may preferably have a volume resistivity of from $10^3$ to $10^{10}$ Ωcm, and particularly from $10^4$ to $10^8$ Ωcm.

The elastic layer 2 may also preferably have a hardness of from 25 to 60 degrees as Asker-C hardness. The elastic layer may further have thickness in the range of from 0.3 mm to 10 mm, and particularly from 1.0 mm to 5.0 mm.

A conductive material used to provide the elastic layer 2 with electrical conductivity may include electron conductive materials and ion conductive materials.

Examples of the electron conductive materials include the following: Conductive carbons such as KETJEN BLACK EC and acetylene black; carbons for rubbers, such as Super Abrasion Furnace or SAF, Intermediate Super Abrasion Furnace or ISAF, High Abrasion Furnace or HAF, Fast Extrusion Furnace or FEF, General Purpose Furnace or GPE, Semi-Reinforcing Furnace or SRF, Fine Thermal or FT and Medium Thermal or MT; carbons for color inks, having been subjected to oxidation treatment; and metals or metal oxides such as copper, silver and germanium.

Of these, carbon black (such as the conductive carbons, the carbons for rubbers or the carbons for color inks) is preferred because the electrical conductivity can readily be controlled by its use in a small quantity.

Examples of the ion conductive materials include the following: Inorganic ion conductive materials such as sodium perchlorate, lithium perchlorate, calcium perchlorate and lithium chloride; and organic ion conductive materials such as modified aliphatic dimethylammonium ethosulfate and stearylammonium acetate.

The conductive material such as these electron conductive materials or ion conductive materials may be used in a quantity necessary for the elastic layer 2 to have an appropriate volume resistivity as stated above. Usually, it may be used in the range of from 0.5 to 50 parts by mass, and preferably from 1 to 30 parts by mass, based on 100 parts by mass of the base material.

(Surface Roughness: Rz Jis)

The developing roller shown in FIG. 1 may have a surface roughness of from 1 to 15 μm, and particularly from 3 to 10 μm, as Rz jis (according to Japan Industrial Standards (JIS) B 0601:2001). This is preferable in order for electrostatic photosensitive members to be stably electrostatically charged.

The surface roughness in the above range may be achieved by, e.g., incorporating roughening particles in the elastic layer 2.

Examples of such roughening particles include the following:

Particles of rubbers such as EPDM, NBR, SBR, CR and silicone rubber;

particles of thermoplastic resins such as PMMA (polymethyl methacrylate), polystyrene, polyolefin and polyvinyl chloride;

particles of elastomers such as polyurethane, polyester or polyamide type thermoplastic elastomers (TPEs); and particles of resins such as a urethane resin, a fluorine resin, a silicone resin, a phenolic resin, a naphthalene resin, a furan resin, a xylene resin, a divinylbenzene polymer, a styrene-divinylbenzene copolymer and a polyacrylonitrile resin.

Any of the foregoing may be used alone or in combination.

(Shaft Member)

The highly conductive shaft 1 in the developing roller shown in FIG. 1, any shaft may be used as long as it has a good electrical conductivity. Usually, a metallic cylinder may be used which is made of aluminum, iron or SUS stainless steel and has an outer diameter of from 4 to 10 mm.

Figure 2:
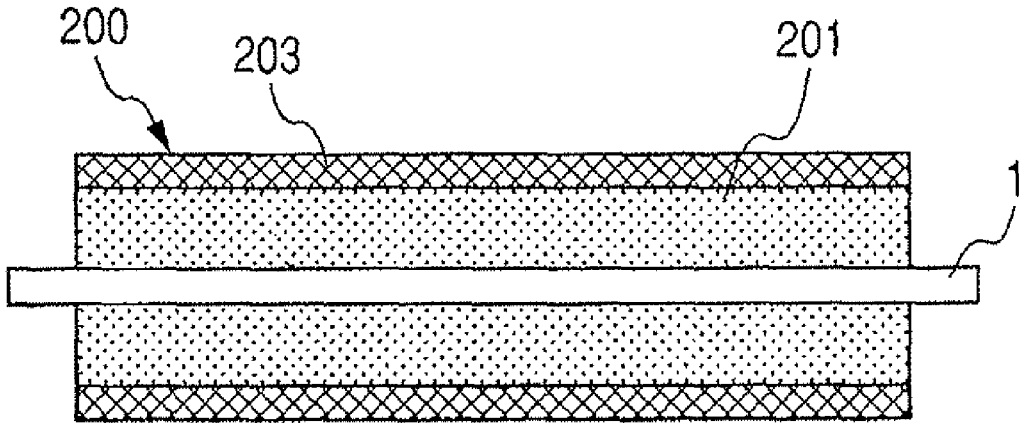
FIG. 2 is a schematic sectional view in the axial direction, showing another embodiment of the developing roller according to the present invention.

FIG. 2 is a schematic sectional view showing another embodiment of the developing roller according to the present invention. A developing roller 200 according to what is shown in FIG. 2 consists of a shaft member 1, an elastic layer 2 which covers the peripheral surface of the shaft member 1, and a resin layer 203 which forms a surface layer, covering the peripheral surface of the elastic layer 201.

The resin layer 203 corresponds to the elastic layer 2 of the developing roller 100 in FIG. 1. Accordingly, in regard to the details of the resin layer 203, the description on the elastic layer 2 is commonly applied except the following.

The resin layer 203 may preferably be a non-foamed solid layer from the viewpoint of a more improvement in uniform chargeability of toners.

The resin layer 203 may also preferably have a volume resistivity of from $10^3$ to $10^{11}$ Ωcm, and particularly from $10^4$ to $10^{10}$ Ωcm, as an appropriate resistance range.

The resin layer 203 may further have thickness in the range of from 0.5 μm to 200 μm, and particularly from 1.0 μm to 100 μm.

Then, the elastic layer 201 contains an elastomer or other resin or the like. The elastic layer 201 may also be incorporated with a conductive material to control its volume resistivity to a preferable resistance range. Such a preferable resistance range may preferably be from $10^3$ to $10^{10}$ Ωcm, and particularly from $10^4$ to $10^8$ Ωcm.

The elastic layer 201 may further preferably have a hardness of from 25 to 60 degrees as Asker-C hardness. The elastic layer 201 may still further preferably have thickness in the range of from 0.3 mm to 10 mm, and particularly from 1.0 mm to 5.0 mm.

Examples of the elastomer or other resin include the following: Polyurethane, natural rubber (NR), butyl rubber (isobutylene-isoprene rubber, IIR), nitrile rubber (NBR), polyisoprene rubber (IR), polybutadiene rubber (BR), silicone rubber, styrene-butadiene rubber (SBR), ethylene-propylene rubber (EPM), ethylene-propylene-diene rubber (EPDM), chloroprene rubber (CR), acrylic rubbers (ACM), and a mixture of any of these.

Of these, silicone rubber and EPDM (ethylene-propylene-diene rubber) are particularly preferred.

As the conductive material, it may include the same conductive material as that which may be added to the elastic layer 2. Also, as to the amount in which it is to be added, that in the case of the elastic layer 2 applies.

To determine the thickness of the elastic layer or resin layer of the developing roller according to the present invention, a roller on which the elastic layer and the resin layer have been formed may crosswise be cut, and the thickness of each layer at its cross section may be measured with a slide gauge or on a videomicroscope. For example, the thickness is measured at 9 spots, and the average value of measurements obtained may be regarded as the thickness of each layer. Where the layer has small thickness as in the case of the resin layer, its cross sections may be observed by using a videomicroscope (magnifications: 1,000 to 3,000) to measure thickness at 9 spots, and the average value of measurements obtained may be regarded as the thickness of each layer.

The developing roller according to the present invention, shown in FIG. 1 or FIG. 2, may be produced, e.g., in the following way.

In regard to the developing roller shown in FIG. 1, it may be produced by casting a composition into a cavity of a molding die previously provided therein with the shaft member; the composition containing the component (a) and the components (b) to (d) or components (b) and (e), used to form the elastic layer 2. The developing roller may also be produced by cutting out a material in the stated shape such as a tubular shape and in the stated size by cutting or the like from a slab, or a block, separately formed using the above composition, and press-fitting the shaft member into this tubular material to form on the shaft member the elastic layer that makes up the surface layer. If necessary, the roller formed may further be subjected to cutting or polishing so as to be adjusted to have the stated outer diameter.

The developing roller shown in FIG. 2 may be produced by, e.g., applying the above composition by a method such as spraying or dipping, on the peripheral surface of the elastic layer 201 formed previously on the peripheral surface of the shaft member, followed by heat curing. The elastic layer 201 may be formed by, e.g., the following process 1) or 2):

1) a process having the step of casting a composition into a cavity of a molding die previously provided therein with the shaft member; the composition being used to form the elastic layer described above; or 2) a process having the step of previously forming a slab or a block by using the composition used to form the elastic layer, and the step of cutting out a material in the stated shape such as a tubular shape and in the stated size by working such as cutting from the slab or block, and press-fitting the shaft member into this tubular material.

In either case of the processes 1) and 2), the roller formed may further optionally be subjected to cutting or polishing after the elastic layer 201 has been formed on the peripheral surface of the shaft member, so as to be adjusted to have the stated outer diameter.

<Developing Assembly>

The developing assembly according to the present invention has at least the developing roller according to the present invention as described above and a developer feed roller.

There are no particular limitations on the developing assembly according to the present invention as long as it is a developing assembly to be provided in electrophotographic image forming apparatus such as copying machines, facsimile machines and printers.

Figure 3:
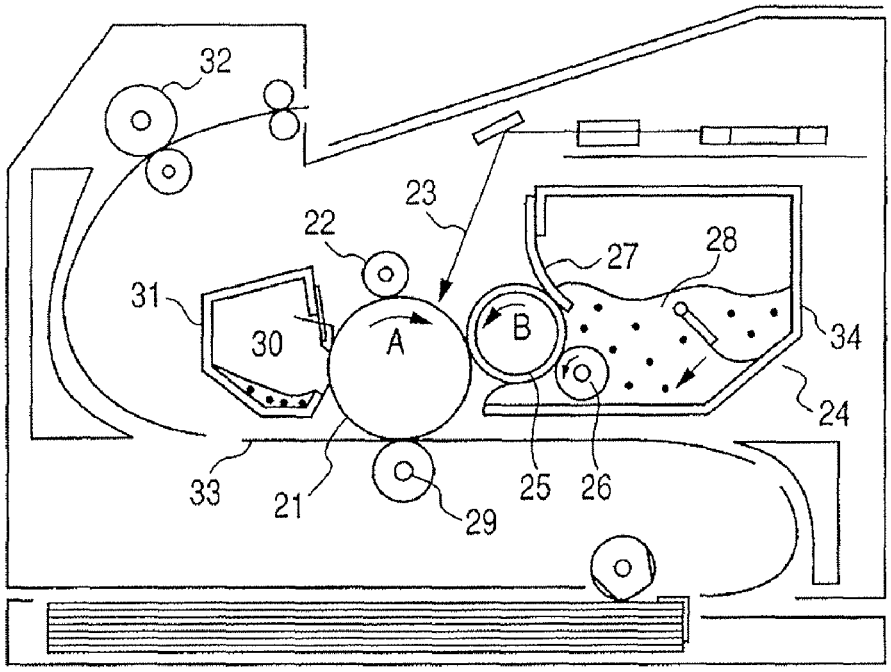
FIG. 3 is a sectional view showing an example of an electrophotographic image forming apparatus making use of the developing assembly according to the present invention.

For example, it may include a developing assembly of an electrophotographic image forming apparatus (detailed later) such as a printer, set up as shown in FIG. 3., in which the developing roller of the present invention is mounted.

The developer feed roller according to the present invention, which is denoted by reference numeral 26 in FIG. 3, is described next in detail.

The developer feed roller has a mandrel and a foamed elastic layer formed around the mandrel. It is preferable for the foamed elastic layer to contain a copolymer of a silicone and a polyether.

Examples of a foamed elastic material used in the foamed elastic layer include the following: Foamed elastic materials obtained by using rubber raw materials such as polyurethane, nitrile rubber, ethylene-propylene rubber, ethylene-propylene-diene rubber, styrene-butadiene rubber, butadiene rubber, isoprene rubber, natural rubber, silicone rubber, acrylic rubber, chloroprene rubber, butyl rubber and epichlorohydrin rubber, or by using monomers which are raw materials for producing these rubber materials (such monomers are also termed as rubber materials in some cases)

The foamed elastic material may also be a foamed elastic material obtained by using any of the above rubber materials alone or a rubber material composed of two or more of any of these rubber materials. Of these foamed elastic materials, a polyurethane foam may preferably be used.

As a polyol component which constitutes raw materials for forming the polyurethane foam, any of known polyols may be used, such as polyether polyols, polyester polyols and polymer polyols, which are commonly used in producing soft polyurethane foams. Also, as a polyisocyanate component which constitutes raw materials for forming the polyurethane foam, any known, at least bifunctional polyisocyanate may be used.

Examples of such a polyisocyanate include the following: 2,4-Tolylene diisocyanate, 2,6-tolylene diisocyanate, orthotoluidiene diisocyanate, naphthylene diisocyanate, xylylene diisocyanate, 4,4'-diphenylmethane diisocyanate, carbodimide modified MDI (diphenylmethane diisocyanate), polymethylene polyphenyl isocyanate, and polymeric polyisocyanates. Any of these may by used alone or in combination.

In such a polyurethane foam raw material composed of a mixture of these polyol component and polyisocyanate component, a copolymer of a silicone and a polyether may preferably be contained. This component plays a role as a foam stabilizer. There are no particular great restrictions on the silicone moiety and the polyether moiety, and known materials may preferably be used.

A cross-linking agent, a blowing agent (water, a low-boiling matter or a gas), a surface-active agent, a catalyst, a conductivity-providing agent for providing a desired electrical conductivity, an antistatic agent and so forth may further be added to the foamed elastic material.

There are no particular limitations on how to produce the developer feed roller, which may be produced by a suitable method selected from among known production methods. Stated specifically, it may be produced by covering a mandrel with the foamed elastic material to form the foamed elastic layer; the mandrel being made of a metallic material such as iron or stainless steel and usually being 4 to 10 mm in diameter and 200 to 400 mm in length. There are no particular limitations on the outer diameter of the developer feed roller. It may have diameter which is in variety depending on its purposes, and may commonly have an outer diameter of from 10 to 20 mm.

For example, first, the above various materials used to form the foamed elastic layer are homogeneously mixed to prepare a polyurethane raw-material composition. Next, using this raw-material composition, the developer feed roller may be produced by using the following method 1) or 2).

1) The raw-material composition is casted into a cavity of a molding die previously provided therein with the mandrel, followed by heating to effect reaction curing or solidification. Thus, the foamed elastic layer is integrally formed to make the developer feed roller.

2) A slab, or a block, of the foamed elastic material is previously formed by using the polyurethane raw-material composition. A material is cut out in the stated shape such as a tubular shape and in the stated size by cutting or the like from the slab or block. Then, the mandrel is press-fitted into this tubular material to cover the surface of the mandrel with the foamed elastic layer to make the developer feed roller.

A method is also available in which these methods are used in combination. If necessary, the roller formed may further be subjected to cutting or polishing so as to be adjusted to have the stated outer diameter.

<Image Forming Apparatus>

The image forming apparatus according to the present invention has an image bearing member for holding thereon electrostatic latent images, a charging assembly for primarily electrostatically charging the image bearing member, and an exposure unit for forming the electrostatic latent images on the image bearing member thus charged primarily. It further has a developing assembly for developing the electrostatic latent images with a developer to form developer images, and a transfer assembly for transferring the developer images to a transfer material. Then, the image forming apparatus according to the present invention has a developing assembly having the developing roller according to the present invention.

FIG. 3 is a sectional view schematically showing the construction of an embodiment of the image forming apparatus of the present invention. A photosensitive drum 21 serving as the image bearing member is rotated in the direction of an arrow A, and is uniformly electrostatically charged by means of a charging member 22 serving as the charging assembly for charge-processing the photosensitive drum 21. The photosensitive drum 21 is exposed to laser beams 23 emitted from an exposure unit which writes electrostatic latent images to the photosensitive drum 21, to form on its surface the electrostatic latent images. The electrostatic latent images are provided with a developer 28 by means of a developing assembly 24 held in a process cartridge detachably mounted to the main body of the image forming apparatus, so that the latent images are developed and rendered visible as developer images.

As development, what is called reverse development is performed which forms the developer images at exposed areas. The developer images on the photosensitive drum which have been rendered visible are transferred to paper 33 serving as the transfer material, by means of a transfer roller 29 serving as the transfer assembly. The paper 33 to which the developer images have been transferred is put to fix-processing by means of a fixing assembly 32, and then delivered out of the apparatus, thus the operation of printing is completed.

Meanwhile, a transfer residual developer having remained on the photosensitive drum 21 without being transferred therefrom is scraped off with a cleaning blade 30 which is a cleaning member for cleaning the photosensitive drum surface, and is received in a waste developer container 31. On the photosensitive drum thus cleaned, the above operation is repeated.

The developing assembly 24 has a developer container 34 holding therein a non-magnetic developer 28 serving as a one-component developer, and a developing roller 25 serving as a developer carrying member which is positioned at an opening extending in the lengthwise direction inside the developer container 34 and is provided opposingly to the photosensitive drum 21. The developing assembly 24 is so disposed as to develop the electrostatic latent images formed on the photosensitive drum 21, to render them visible. The electrophotographic process cartridge has at least one of the developing assembly 24, the image bearing member 21, the charging member 22, the cleaning blade 30 and the transfer roller 29, which are integrally retained, and is detachably mountable to the main body of the image forming apparatus.

The developing roller 25 is kept in contact with the photosensitive drum 21 in a certain contact width. In the developing assembly 24, the developer feed roller 26 is, inside the developer container 34, kept in contact with the developing roller 25 on its upstream side in the rotational direction with respect to the part of contact of a developing blade, a developer layer thickness control member, with the surface of the developing roller 25, and is rotatably supported.

According to a category of the present invention, a developing roller can be obtained which can stably provide electrophotographic images having a high quality level.

According to another category of the present invention, an image forming apparatus can be obtained which can stably provide electrophotographic images having a high quality level.

EXAMPLES

The present invention is described below in greater detail by giving Examples and Comparative Examples. These Examples by no means limit the scope of the present invention.

In these Examples, the following alcohols were used.

| Alcohol (1)<br>The following raw materials were readied. | (by mass) |
|---|---|
| Polytetramethylene ether glycol (trade name: PTG1000SN, available from Hodogaya Chemical Co., Ltd.) | 100 parts |
| Isocyanate (trade name: MILLIONATE MT, available from Nippon Polyurethane Industry Co., Ltd.) | 18.7 parts |

These raw materials were stepwise mixed in methyl ethyl ketone (MEK) to carry out reaction at 80° C. for 3 hours in an atmosphere of nitrogen to obtain a bifunctional polyether diol prepolymer [a polyether diol (BO) having the unit represented by the formula (1)]. The polyether diol prepolymer obtained had a weight average molecular weight Mw of 10,000 and a hydroxyl value of 18.2 mgKOH/g. This was used as an alcohol (1).

| Alcohol (2) | (by mass) |
|---|---|
| Polytetramethylene glycol (trade name: PTG650SN, available from Hodogaya Chemical Co., Ltd.) | 100 parts |
| Trimethylol propane (available from Mitsubishi Gas Chemical Company, Inc.) | 3 parts |
| Isophorone diisocyanate (available from Aldrich Chemical Co., Inc.) | 30 parts |

These raw materials were stepwise mixed in methyl ethyl ketone (MEK) to carry out reaction at 80° C. for 3 hours in an atmosphere of nitrogen to obtain a polyether diol prepolymer [a polyether diol (BO) having the unit represented by the formula (1)]. The polyether diol prepolymer obtained had a weight average molecular weight Mw of 6,800 and a hydroxyl value of 43 mgKOH/g. This was used as an alcohol (2).

Alcohol (3)

LB385 [available from Sanyo Chemical Industries, Ltd.; a monofunctional polyether alcohol (PO) having the unit represented by the formula (2)] was used as an alcohol (3).

Alcohol (4)

G100 [available from Mitsui Takeda Chemicals, Inc.; a trifunctional polyether triol (PO) having the unit represented by the formula (2)] was used as an alcohol (4).

Alcohol (5)

Poly(ethylene glycol) methyl ether (PEME) [available from Aldrich Chemical Co., Inc.; a monofunctional polyether alcohol (EO) having the unit represented by the formula (3)] was used as an alcohol (5).

Alcohol (6)

HB260 [available from Sanyo Chemical Industries, Ltd.; a monofunctional polyether alcohol (PO-EO) simultaneously having the units represented by the formulas (2) and (3)] was used as an alcohol (6).

Example 1

A mandrel (shaft member) of 8 mm in outer diameter was placed in a cylindrical mold of 16 mm in inner diameter in such a way that they were symmetrical, and a liquid conductive silicone rubber (a product available from Dow Corning Toray Silicone Co., Ltd.; Asker-C hardness: 45 degrees; volume resistivity: $1\times10^7$ Ωcm) was casted thereinto as a material for forming an elastic layer. After it was casted thereinto, the mold was put into a 130° C. oven to heat it for 20 minutes. After demolding, the molded product was subjected to secondary vulcanization in a 200° C. oven to form an elastic layer 201 of 4 mm in thickness on the peripheral surface of the mandrel.

Next, a fluid mixture of the following raw materials was prepared.

| | (by mass) |
|---|---|
| Alcohol (1) | 100 parts |
| Alcohol (3) | 3.1 parts |
| Alcohol (5) | 2 parts |
| Isocyanate C2521 (available from Nippon Polyurethane Industry Co., Ltd.; solid content: 65%) | 125 parts |

To the fluid raw-material mixture obtained, methyl ethyl ketone (MEK) was added to adjust solid content so as to be 25 to 30% by mass to prepare a resin layer forming raw-material fluid. To this raw-material fluid, based on 100 parts by mass thereof, 20 parts by mass of carbon black MA230 (available from Mitsubishi Chemical Corporation) and 15 parts by mass of acrylic-resin particles MX-1000 (available from Soken Chemical & Engineering Co., Ltd.) were added, and the resultant coating fluid was subjected to dispersion with stirring by means of a ball mill to prepare a coating material. The coating material obtained was applied by dip coating on the elastic layer formed previously by molding, followed by drying for 15 minutes in a 80° C. oven and thereafter curing for 4 hours in a 140° C. oven to form a resin layer 203 having a layer thickness of 15 μm, to obtain a developing roller.

Examples 2 to 9 & Comparative Examples 1 and 2

Developing rollers were produced in the same manner as in Example 1 except that the alcohols and isocyanate used in preparing the raw-material fluid for forming the resin layer were mixed as shown in Table 1 below.

TABLE 1

Unit: part(s) by mass

| Component | Material | Example 1 | 2 | 3 | 4 | 5 | 6 | 7 | 8 | 9 | Comparative Example 1 | 2 |
|---|---|---|---|---|---|---|---|---|---|---|---|---|
| (a) | Isocyanate | 125 | 213.3 | 187 | 154.9 | 172 | 139 | 160 | 102 | 201.1 | 145 | 120 |
| (b) | Alcohol (1) | 100 | 79.3 | 124 | 89.2 | — | 100 | — | 100 | — | — | — |
| (b) | Alcohol (2) | — | 39.7 | 61.9 | 44.6 | 100 | — | 100 | — | 100 | 100 | — |
| (c) | Alcohol (3) | 3.1 | — | — | — | 25 | 2 | 30 | — | — | — | — |
| (c) | Alcohol (4) | — | — | — | — | — | — | — | — | — | — | 100 |
| (d) | Alcohol (5) | 2 | — | — | — | 20 | 1.5 | 30 | — | — | — | 20.1 |
| (e) | Alcohol (6) | — | 47.6 | 9.3 | 22.7 | — | — | — | 2 | 50 | — | — |

Production of Developer Feed Roller

Next, a production example of a developer feed roller usable in the present invention is shown below.

| The following materials were beforehand mixed. | (by mass) |
|---|---|
| FA908 (trade name; available from Sanyo Chemical Industries, Ltd.; a polyol) | 90 parts |
| POP34-28 (trade name; available from Sanyo Chemical Industries, Ltd.; a polyol) | 10 parts |
| TOYOCAT-ET (trade name; available from Tosoh Corporation; a tertiaryamine catalyst) | 0.1 parts |
| TOYOCAT-L33 (trade name; available from Tosoh Corporation; a tertiaryamine catalyst) | 0.5 parts |
| Water (blowing agent) | 2.5 parts |
| SH190 (trade name; available from Dow Corning Toray Silicone Co., Ltd.; a copolymer of a silicone and a polyether) | 1 part |

Thereafter, to the resultant mixture, 24 parts by mass of COLONATE 1021 (trade name; available from Nippon Polyurethane Industry Co., Ltd.; NCO %: 45) as a polyisocyanate was added, and these were mixed and stirred. Next, foam molding (foam casting) was carried out using the same molding die as that used in Example 1. Thus, a 4.5 mm thick, foamed elastic layer composed of polyurethane sponge was integrally formed around a mandrel of 5 mm in outer diameter to produce a developer feed roller.

Measurement of Contact Angle

A contact angle meter CA-S ROLL (trade name), manufactured by Kyowa Interface Science Co., Ltd., was used. As a needle for injecting a dropping fluid, a 15-gauge needle available from Kyowa Interface Science Co., Ltd. was used. Droplets were about 1.5 mm in droplet diameter in the direction of dropping. In a normal-temperature and normal-humidity environment (23° C./65%), 10 droplets were dropped, and contact angles after 10 seconds were measured. The average value of contact angles of 8 droplets, excluding each droplet showing the maximum value and minimum value among contact angles of 10 droplets, was found by rounding-off. As the ethylene glycol and diiodomethane to be dropped, those available from Aldrich Chemical Co., Inc. were used.

Measurement of Rz Jis

A contact surface profile analyzer (SURFCORDER SE-3300, manufactured by Kosaka Laboratory Ltd.) was used to measure the surface roughness Rz jis, which was measured under conditions set to be a cut-off value of 0.8 mm, a measurement length of 2.5 mm, a feed speed of 0.1 mm/second and a power of 5,000 magnifications. As to the number of measuring spots, the measurement was made at arbitrary 10 spots on the developing roller surface in the development region, and the average value of measurements was found. The results of measurement of Rz jis of the respective rollers are shown in Table 2.

Measurement of Asker-C Hardness

The Asker-C hardness was measured according to a rubber material hardness measuring method. Stated specifically, it was measured with an Asker rubber hardness meter (manufactured by Kobunshi Keiki Co., Ltd.), using a test piece separately prepared according to a reference standard Asker-C SRIS (Society of Rubber Industry Standard) 0101. The results of measurement of Asker-C hardness of the respective rollers are shown in Table 2.

Measurement of Electrical Conductivity

Figure 4:
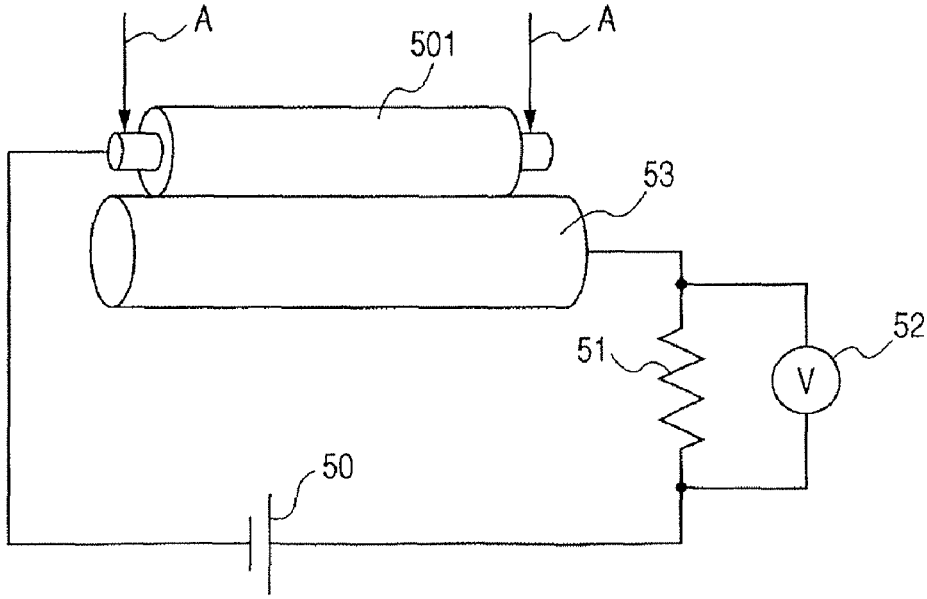
FIG. 4 illustrates how to measure electrical resistance of the developing roller according to the present invention.

The electrical resistance of the developing roller was measured with an electrical resistance measuring instrument shown in FIG. 4. A load was applied at 500 g each to the mandrel both end portions (shown by arrows A in FIG. 4) of a developing roller 501. This developing roller 501 was pressed against a metallic drum 53 and rotated at the number of roller revolutions of 1 rps, during which a voltage of 50 V was applied from a power source 50. The voltages applied to a resistance 51 (10 kΩ) which were indicated here on a voltmeter 52 were read for 30 seconds, and their average value was found to determine the value of roller electrical resistance. The results of measurement of electrical resistance (electrical conductivity) of the respective rollers are shown in Table 2.

TABLE 2

| | Rz jis | Asker-C hardness | Electrical conductivity (Ω) |
|---|---|---|---|
| Example: | | | |
| 1 | 10.2 | 45 | $1.2 \times 10^5$ |
| 2 | 10.8 | 45 | $1.1 \times 10^5$ |
| 3 | 9.3 | 45 | $1.1 \times 10^5$ |
| 4 | 9.7 | 45 | $1.2 \times 10^5$ |
| 5 | 10.0 | 45 | $1.0 \times 10^5$ |
| 6 | 10.3 | 45 | $1.1 \times 10^5$ |
| 7 | 9.9 | 45 | $9.9 \times 10^4$ |
| 8 | 9.9 | 45 | $1.2 \times 10^5$ |
| 9 | 10.4 | 45 | $1.3 \times 10^5$ |
| Comparative Example: | | | |
| 1 | 10.5 | 45 | $1.1 \times 10^5$ |
| 2 | 9.6 | 45 | $1.3 \times 10^5$ |

Image Evaluation (Evaluation on Banding Caused at the Part of Contact Between Developing Roller and Developer Feed Roller)

The developing roller and the developer feed roller set in the electrophotographic process cartridge. This cartridge was left for 30 days in a high-temperature and high-humidity environment (40° C./95% RH). Thereafter, images were actually reproduced using a color laser printer (trade name: LBP5500, manufactured by CANON INC.) to make image evaluation. A magenta developer with particles of 7.0 μm in number average particle diameter was used as the developer. The number average particle diameter of the developer was calculated from number distribution measured with a laser diffraction particle size distribution meter (trade name; COULTER LS-130 Particle Size Distribution Meter; manufactured by Beckman Coulter, Inc.).

Images obtained were visually observed to make evaluation on banding in halftone images according to the following criteria.

A: No banding is seen.

B: Banding is seen which is very slight enough to be of no problem in practical use.

C: Banding is seen.

The results of evaluation are shown in Table 3.

As is clear from comparison of the results in Examples 1 to 9 and Comparative Examples 1 and 2 as shown in Table 3, the developing rollers of Examples 1 to 9 had surfaces having contact angles to ethylene glycol of from 60.0 degrees or more to 90.0 degrees or less and also contact angles to diiodomethane of from 30.0 degrees or more to 38.0 degrees or less. In the cases in which these developing rollers were used, images with a high quality level were obtainable in which any banding came about in halftone images even though each developing roller was kept in contact with the developer feed roller at the same position over a long period of time.

TABLE 3

| | Contact angle to: | | | | | | |
|---|---|---|---|---|---|---|---|
| | Ethylene glycol (deg.) | Diiodomethane (deg.) | Mass ratio | | | | Banding |
| | | | BO | PO | EO | PO-EO | |
| Example: | | | | | | | |
| 1 | 66.1 | 31.0 | 100 | 3 | 2 | — | A |
| 2 | 62.8 | 35.6 | 100 | — | — | 40 | A |
| 3 | 65.9 | 30.9 | 100 | — | — | 5 | A |
| 4 | 64.0 | 33.0 | 100 | — | — | 17 | A |
| 5 | 62.0 | 36.2 | 100 | 25 | 20 | — | A |
| 6 | 66.5 | 31.2 | 100 | 2 | 1.5 | — | B |
| 7 | 60.2 | 38.0 | 100 | 30 | 30 | — | B |
| 8 | 66.8 | 30.1 | 100 | — | — | 2 | B |
| 9 | 61.0 | 37.1 | 100 | — | — | 50 | B |
| Comparative Example: | | | | | | | |
| 1 | 67.5 | 29.6 | 100 | — | — | — | C |
| 2 | 58.1 | 41.0 | — | 100 | 20 | — | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-326168, filed Nov. 10, 2005, which is hereby incorporated by reference herein in its entirety.

What is claimed is:

1. A developing roller which comprises:

a shaft member; and an elastic layer which covers a peripheral surface thereof;

said developing roller having a surface layer, wherein said surface layer comprises a urethane resin composed of a reaction product of the following component (a) with alcohols comprising the following components (b) to (d) or the following components (b) and (e), and has a surface having a contact angle to ethylene glycol of from 60.0 degrees or more to 90.0 degrees or less and a contact angle to diiodomethane of from 30.0 degrees or more to 38.0 degrees or less:

(a) an isocyanate;

(b) an alcohol containing a unit represented by the following formula (1);

(c) an alcohol containing a unit represented by the following formula (2);

(d) an alcohol containing a unit represented by the following formula (3); and (e) an alcohol containing a unit represented by the following formula (2) and a unit represented by the following formula (3):

(1)

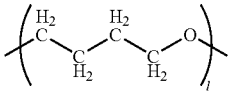

wherein 1 represents a positive integer;

(2)

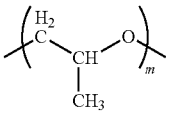

wherein m represents a positive integer;

(3)

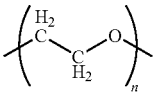

wherein n represents a positive integer.

2. The developing roller according to claim 1, wherein the group of said alcohols comprises the component (c) and the component (d) in proportions of from 3 parts by mass or more to 25 parts by mass or less and from 2 parts by mass or more to 20 parts by mass or less, respectively, based on 100 parts by mass of the component (b).

3. The developing roller according to claim 1, wherein the group of said alcohols comprises the component (e) in a proportion of from 5 parts by mass or more to 40 parts by mass or less based on 100 parts by mass of the component (b).

4. The developing roller according to claim 1, wherein said component (b) has two or more hydroxyl groups.

5. The developing roller according to claim 1, wherein said component (c) has one hydroxyl group.

6. The developing roller according to claim 1, wherein said component (d) has one hydroxyl group.

7. The developing roller according to claim 1, wherein said component (e) has one hydroxyl group.

8. A developing assembly which comprises the developing roller according to claim 1 and a developer feed roller.

9. The developing assembly according to claim 8, wherein said developer feed roller comprises a mandrel and a foamed elastic layer form around the mandrel, and the foamed elastic layer contains a copolymer of a silicone and a polyether.

10. An image forming apparatus which comprises an image bearing member for holding thereon an electrostatic latent image, a charging assembly for primarily electrostatically charging the image bearing member, an exposure unit for forming the electrostatic latent image on the image bearing member thus charged primarily, a developing assembly for developing the electrostatic latent image with a developer to form a developer image, and a transfer assembly for transferring the developer image to a transfer material, wherein;

said developing assembly is the developing assembly according to claim 8.

11. An image forming apparatus which comprises an image bearing member for holding thereon an electrostatic latent image, a charging assembly for primarily electrostatically charging the electrostatic latent image bearing member, an exposure unit for forming the electrostatic latent image on the image bearing member thus charged primarily, a developing assembly for developing the electrostatic latent image with a developer to form a developer image, and a transfer assembly for transferring the developer image to a transfer material, wherein;

said developing assembly is the developing assembly according to claim 9.

12. A process for producing a developing roller comprising the steps of covering a peripheral surface of a shaft member or an elastic layer with a composition containing the following component (a) and the following components (b) to (d) or the following components (b) and (e), and then allowing the component (a) to react with the components (b) to (d) or the components (b) and (e) to form a surface layer which has a surface having a contact angle to ethylene glycol of from 60.0 degrees or more to 90.0 degrees or less and a contact angle to diiodomethane of from 30.0 degrees or more to 38.0 degrees or less:

(a) an isocyanate;

(b) an alcohol containing a unit represented by the following formula (1);

(c) an alcohol containing a unit represented by the following formula (2);

(d) an alcohol containing a unit represented by the following formula (3); and (e) an alcohol containing a unit represented by the following formula (2) and a unit represented by the following formula (3):

(1)

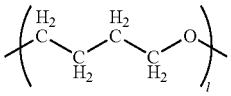

wherein l represents a positive integer;

(2)

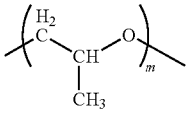

wherein m represents a positive integer;

(3)

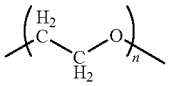

wherein n represents a positive integer.

13. The process for producing a developing roller according to claim 12, wherein said component (b) has two or more hydroxyl groups, said component (c) has one hydroxyl group, said component (d) has one hydroxyl group, and said component (e) has one hydroxyl group.

* * * * *